US005571653A

United States Patent [19]

Kasuya et al.

[11] Patent Number: 5,571,653

[45] Date of Patent: Nov. 5, 1996

[54] TONER FOR DEVELOPING ELECTROSTATIC IMAGES, AND PROCESS FOR ITS PRODUCTION

[75] Inventors: Takashige Kasuya, Soka; Tatsuya Nakamura, Tokyo; Makoto Kanabayashi, Kawasaki; Tatsuhiko Chiba, Kamakura; Kazuyuki Miyano, Tokyo; Koji Inaba, Yokohama, all of Japan

[73] Assignee: Canon Kabushiki Kaisha, Tokyo, Japan

[21] Appl. No.: 325,479

[22] Filed: Oct. 19, 1994

[30] Foreign Application Priority Data

Oct. 20, 1993 [JP] Japan ..... 5-284201
Oct. 4, 1994 [JP] Japan ..... 6-263258

[51] Int. Cl.[6] ..... G03G 9/087

[52] U.S. Cl. ..... 430/109; 430/110; 430/111; 430/137

[58] Field of Search ..... 430/109, 111, 430/110, 137

[56] References Cited

U.S. PATENT DOCUMENTS

| | | | |
|---|---|---|---|
| 2,297,691 | 10/1942 | Carlson | 430/55 |
| 5,116,712 | 5/1992 | Nakamura et al. | 430/106 |
| 5,213,933 | 5/1993 | Osaki et al. | 430/110 |
| 5,219,697 | 6/1993 | Mori et al. | 430/110 |
| 5,272,212 | 12/1993 | Kitahara | 525/301 |
| 5,406,357 | 4/1995 | Nakahara et al. | 430/110 |

FOREIGN PATENT DOCUMENTS

| | | |
|---|---|---|
| 0371812 | 6/1990 | European Pat. Off. . |
| 0531932 | 3/1993 | European Pat. Off. . |
| 2070031 | 9/1981 | United Kingdom . |

OTHER PUBLICATIONS

Patent Abstracts, Japan, vol. 7, No. 30 (P–173) (1175) Feb. 1983; Database WPI, Section Ch, Week 9315, Derwent, Class G06, AN 93–122252.

Database WPI, Section Ch, Week 9015, Derwent, Class G05, AN 8–111467.

*Primary Examiner*—Hoa Van Le
*Attorney, Agent, or Firm*—Fitzpatrick, Cella, Harper & Scinto

[57] ABSTRACT

A toner for developing an electrostatic image comprises toner particles containing a binder resin, a colorant and a wax. The toner contains polymerizable vinyl monomer or a mixture of organic solvent and polymerizable vinyl monomer in an amount of not more than 1,000 ppm. The toner particles are those obtained by mixing a mixture containing, at least, one or plural kinds of polymerizable vinyl monomer, a styrene-diene copolymer comprised of styrene or a styrene derivative and butadiene or isoprene in a copolymerization weight ratio of from 95:5 to 65:35, the colorant, the wax and a polymerization initiator to prepare a polymerizable monomer composition; dispersing the polymerizable monomer composition in an aqueous medium to carry out granulation; and polymerizing the polymerizable vinyl monomer in the aqueous medium.

18 Claims, No Drawings

TONER FOR DEVELOPING ELECTROSTATIC IMAGES, AND PROCESS FOR ITS PRODUCTION

BACKGROUND OF THE INVENTION

1. Field of the Invention

This invention relates to a toner for developing electrostatic images, and a process for producing it.

2. Related Background Art

To conduct electrophotography, a large number of methods are known in the art as disclosed, for example, in U.S. Pat. No. 2,297,691. In general, in such electrophotography, an electrostatic latent image is formed on a photosensitive member, utilizing a photoconductive material and according to various means, and subsequently the latent image is developed using a toner to form a toner image. The toner image is transferred to a transfer medium such as paper if necessary, and then the toner image thus transferred is fixed to the transfer medium by heating, pressing, heat-pressing or using solvent vapor. A copy is thus obtained. At present, fixing methods that utilize heat are in general use because copied images can be firmly fixed, transferred images can be readily handled and fixing can be comfortably operated. As heat-fixing methods, there are methods that utilize radiation heat as in the heat chamber method. In view of a high thermal efficiency, a high-speed response and a high safety, a heat-roll fixing method in which a heated roll-like heating member (e.g., a heat roll) is brought into pressure contact with toner images to fix them is most widely employed in copying machines. Although this method has a high thermal efficiency, the energy used for heat melting occupies a rather large position in copying machines. Also, molten toner images come in direct contact with the heat roll, so that the toner may adhere to the heat roll to cause stains on subsequent images, i.e., an offset phenomenon, or, in an extreme instance, to make the transfer medium wind around the heat roll, i.e., a wind-around phenomenon.

As a process for producing toners, it is known to use a process in which a colorant such as a dye or pigment and additives such as a charge control agent are melt-kneaded into a thermoplastic resin (binder resin) to carry out uniform dispersion, thereafter the resulting melt-kneaded product is cooled, the cooled product is pulverized, and the pulverized product is classified to produce toner particles having the desired particle diameters.

In the process for producing toners by such pulverization, there are limitations when a release agent such as wax is added to toner particles. That is, in order to disperse the release agent at a satisfactory level, the release agent must not dissolve to turn into liquid at the temperature where it is kneaded with the binder resin, and the release agent must be used in a large content. Because of such limitations, it is not easy to improve fixing performance of toners.

Meanwhile, it is proposed to use a method in which a toner containing a release agent such as wax is produced by suspension polymerization or emulsion polymerization. In this suspension polymerization, a monomer composition is prepared by uniformly dissolving or dispersing a colorant (optionally together with a polymerization initiator, a cross-linking agent, a charge control agent and other additives) in polymerizable monomers, and thereafter the monomer composition is dispersed by means of a suitable stirrer in a continuous phase (e,g, an aqueous phase) containing a dispersion stabilizer, to carry out polymerization to obtain toner particles having the desired particle diameters.

In this suspension polymerization, the monomer composition is granulated in a highly polar dispersion medium such as water, and hence the particles formed take a pseudo-capsular structure in which components having polar groups, contained in the monomer composition, are present in the surface layer portion which forms the interface between the particles and the dispersion medium, and non-polar components are present in the inside. Utilizing such a characteristic of this method, it is possible to encapsulate a low-melting wax in the toner particles.

Because of the encapsulation of a low-melting wax, the toner produced by polymerization can achieve both anti-blocking and low-temperature fixing, which are performances conflicting with each other. Since the low-melting wax is encapsulated in toner particles, the wax melting at a lower temperature contributes to an improvement in thermal conductivity of toner without lowering anti-blocking properties, so that it becomes possible to fix the toner at a lower temperature. As an additional advantage, the wax having melted at the time of fixing also acts as a release agent, and hence it is possible to prevent high-temperature offset without applying a release agent such as silicone oil to the fixing roll.

When the low-melting wax is, however, dissolved or dispersed in a large quantity in the monomer composition to carry out granulation in an aqueous medium, it is difficult to carry out the granulation compared with the case of a monomer composition containing no wax, tending to allow the resulting toner to have a broad particle size distribution.

SUMMARY OF THE INVENTION

An object of the present invention is to provide a toner for developing electrostatic images, having solved the problems discussed above, and a process for producing such a toner.

Another object of the present invention is to provide a toner for developing electrostatic images, having a sharp particle size distribution, and a process for producing such a toner.

Still another object of the present invention is to provide a toner for developing electrostatic images, having a superior low-temperature fixing performance and superior anti-offset properties in high-temperature fixing, and a process for producing such a toner.

Still another object of the present invention is to provide a toner for developing electrostatic images, having superior anti-blocking properties, and a process for producing such a toner.

The present invention provides a toner for developing an electrostatic image, comprising toner particles containing a binder resin, a colorant and a wax, wherein;

the toner contains polymerizable vinyl monomer or a mixture of organic solvent and polymerizable vinyl monomer in an amount of not more than 1,000 ppm; and the toner particles have been obtained by mixing a mixture containing, at least, one or plural kinds of polymerizable vinyl monomer, a styrene-diene copolymer comprised of styrene or a styrene derivative and butadiene or isoprene in a copolymerization weight ratio of from 95:5 to 65:35, the colorant, the wax and a polymerization initiator to prepare a polymerizable monomer composition; dispersing the polymerizable monomer composition in an aqueous medium to carry out granulation; and polymerizing the polymerizable vinyl monomer in the aqueous medium.

The present invention also provides a process for producing a toner, comprising the steps of:

mixing a mixture containing, at least, one or plural kinds of polymerizable vinyl monomer, a styrene-diene copolymer comprised of styrene or a styrene derivative and butadiene or isoprene in a copolymerization weight ratio of from 95:5 to 65:35, a colorant, a wax and a polymerization initiator to prepare a polymerizable monomer composition;

dispersing the polymerizable monomer composition in an aqueous medium to carry out granulation; and polymerizing the polymerizable vinyl monomer in the aqueous medium to produce toner particles which contain a binder resin, the colorant and the wax, and contain polymerizable vinyl monomer or a mixture of organic solvent and polymerizable vinyl monomer in an amount of not more than 1,000 ppm.

DESCRIPTION OF THE PREFERRED EMBODIMENTS

The present inventors have hitherto brought out toners which are feasible for low-temperature fixing, incorporated with a large quantity of wax by taking advantage of the properties that the polymerization in an aqueous medium is initiated at the interface between a particle and the aqueous medium, polar components gather in the vicinity of the interface and non-polar components gather in the central part.

With suspension polymerization, in the case of styrene or acrylic polymerizable vinyl monomers, toner compositions preferable for heat-fixing toners can be obtained when a polymerization initiator is used in an amount of 0.5 to 20% by weight and the polymerization temperature is so set as for the half-life of the polymerization initiator to be 0.5 to 30 hours.

When the polymerization conversion reaches 90% or more under such conditions, toner particles no longer coalesce into masses even if stirring is stopped, and the reaction product may be taken out when the polymerization conversion reaches 97% to 98%, and then dried.

However, incorporation of a low-melting wax in a large quantity into toner particles may cause a great decrease in developability when toners are left standing in an environment of high temperature, although images with a good quality can be obtained without any problem in usual environment.

In the suspension polymerization, as the polymerization reaction proceeds, the viscosity of a polymerizable monomer composition increases to make it hard for radical species and polymerizable vinyl monomers to move, so that unreacted polymerizable vinyl monomers tend to remain in toner particles. In the case of toners produced by pulverization, any polymerizable monomers remaining can be removed by the heat applied during the preparation of binder resins or during melt-kneading. Since, however, no high heat must be applied to toner particles when toners are directly formed by suspension polymerization, a large quantity of polymerizable monomers tend to exist inside the toner particles compared with the toners produced by pulverization. When the toners produced by suspension polymerization are left standing at a high temperature in the state where no water is present, unreacted polymerizable monomers remaining therein gradually volatilize from the surfaces of toner particles, during which low-molecular weight components and non-polar components (e.g., a low-melting wax) inside the toner particles are presumed to be transported toward the surface portions of toner particles to cause a deterioration of developing performance of toners. In the toner particles, volatile organic solvent components can be also present in a very small quantity in addition to the polymerizable monomers. Thus, controlling the content of these so as to be not more than 1,000 ppm makes it possible to obtain a toner that can be free from deterioration even when the toner contains a low-melting wax encapsulated in its particles and is left standing in an environment of high temperature.

For saving the step of classification, improving developing performance and making image quality higher, it is important to directly obtain by suspension polymerization or emulsion polymerization a toner having a sharp particle size distribution.

The present inventors have discovered that the toner having a sharp particle size distribution can be obtained when a styrene-diene copolymer comprised of styrene or a styrene derivative and butadiene or isoprene in a copolymerization weight ratio of from 95:5 to 65:35, having both properties of polymer and properties of wax, is dissolved and mixed in polymerizable monomers.

The reason therefor is that the styrene-diene copolymer acts to well encapsulate the wax in the step of granulation.

The styrene-diene copolymer used in the present invention may preferably be a block copolymer so that the present invention can be very effective.

A styrene-diene copolymer having styrene or a styrene derivative in a copolymerization weight ratio of more than 95% by weight, in other words, a styrene-diene copolymer having butadiene or isoprene in a copolymerization weight ratio of less than 5%, can be less effective for the improvement in granulation performance in an aqueous medium. On the other hand, a styrene-diene copolymer having styrene or a styrene derivative in a copolymerization weight ratio of less than 65% may cause a lowering of anti-blocking properties of the toner. A styrene-diene copolymer having butadiene or isoprene in a copolymerization weight ratio of more than 35% has excess diene units which may cause a decrease in stability of the particles of the polymerizable monomer composition in an aqueous medium.

The styrene-diene copolymer may more preferably be a block copolymer in which styrene polymer chains or styrene derivative polymer chains and butadiene polymer chains or isoprene polymer chains are block-polymerized, in view of the granulation performance of the polymerizable monomer composition in an aqueous medium, the encapsulation of wax and the improvement in anti-blocking properties of toner particles.

When such a styrene-diene block copolymer is used, its $CH_2{=}CH{-}$ groups present in the butadiene polymer blocks or isoprene polymer blocks improves the stability of the polymerizable monomer composition when the polymerizable monomer composition is granulated in an aqueous medium, and more favorably prevents formation of fine particles and formation of coarse particles, so that the toner is made to have a sharp particle size distribution. Moreover, since the styrene polymer blocks or styrene derivative polymer blocks have a high glass transition point, the toner can be more improved in anti-blocking properties.

The $CH_2{=}CH{-}$ groups possessed by the styrene-diene copolymer react with polymerizable vinyl monomers in the course of the polymerization of the polymerizable vinyl monomers to facilitate branch formation and network formation of binder resin components, so that the toner can be improved in anti-offset properties.

The styrene-diene copolymer used in the present invention may preferably have a weight average molecular weight of from 30,000 to 500,000, and more preferably from 50,000 to 300,000.

Where the total of double bonds remaining in the styrene-diene copolymer is 100, the $CH_2$=CH— groups may preferably be present as side chains in a rate of from 5 to 60, and more preferably from 10 to 50, in order to improve anti-blocking properties of the toner, to improve anti-offset properties thereof and to more improve granulation performance of the polymerizable monomer composition in an aqueous medium.

The styrene-diene copolymer may preferably contained in the toner in an amount of from 0.1 to 20% by weight. The styrene-diene copolymer may more preferably be contained in an amount of from 1 to 50% by weight based on the weight of the wax, in order to enable effective encapsulation of the wax into toner particles and to improve anti-blocking properties and fluidity of the toner.

The wax may preferably be contained in the toner in an amount of from 5 to 30% by weight, and the wax used in the present invention may include paraffin, polyolefin and ester type waxes.

The wax may preferably be those having a melting point of from 50° to 90° C. since it can achieve the low-temperature fixing.

The polymerizable vinyl monomers that constitute the polymerizable monomer composition used in the present invention may include the following.

The polymerizable vinyl monomer can be exemplified by styrene; styrene derivatives such as o-methylstyrene, m-methylstyrene, p-methylstyrene, p-methoxystyrene and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and monomers such as acrylonitrile, methacrylonitrile and acrylamide.

These vinyl monomers may be used alone or in combination. Of the foregoing vinyl monomers, styrene or a styrene derivative may preferably be used alone or in combination with an acrylate or methacrylate in view of developing performance and running performance of the toner.

In the present invention, a resin other than the styrene-diene copolymer may also be added to the polymerizable monomer composition to carry out polymerization. For example, in some instances, a hydrophilic functional group such as an amino group, a carboxylic acid, a hydroxyl group, a sulfonic acid group, a glycidyl group or a nitrile group, which can not be used in the form of monomers because of its water-soluble properties on account of which the monomers dissolve in an aqueous suspension to cause emulsion polymerization to take place, should be introduced into the toner. In such instances, it can be used in the form of a copolymer such as a random copolymer, a block copolymer or a graft copolymer, of a vinyl monomer having such a hydrophilic functional group and a vinyl monomer such as styrene or ethylene, or in the form of a polycondensate such as polyamide or a polyaddition polymer such as polyether or polyimine. When a high polymer containing such a polar functional group is present together in the toner, the wax component described above can be phase-separated to enable better encapsulation, bringing about an improvement in the performance of toner. Thus, this is a preferred embodiment. Such a high polymer may preferably be used in an amount of from 1 to 20% by weight based on the weight of the polymerizable vinyl monomer. The high polymer containing the polar functional group may have a weight average molecular weight of not less than 5,000. Such a polymer is preferably used. If it has a weight average molecular weight less than 5,000, in particular, less than 4,000, the anti-blocking properties may become lower undesirably. A polymer having a molecular weight range different from that of the toner obtained by polymerizing monomers may be dissolved in the monomers, whereby a toner having a broad molecular weight distribution and a high anti-offset properties can be obtained.

As the colorant used in the present invention, known colorants can be used, as exemplified by dyes such as C.I. Direct Red 1, C.I. Basic Red 1, C.I. Mordant Red 30, C.I. Direct Blue 1, C.I. Direct Blue 2, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6, and pigments such as carbon black, chrome yellow, cadmium yellow, mineral first yellow, navel yellow, Naphthol Yellow S, Hanza Yellow G, Permanent Yellow NCG, Tartrazine Lake, molybdenum orange GTR, Benzidine Orange G, Cadmium Red 4R, Watchung Red calcium salt, Brilliant Carmine 3B, Fast Violet B, Methyl Violet Lake, Prussion blue, cobalt blue, Alkali Blue Lake, Victoria Blue Lake, quinacridone, Rhodamin Lake, Phthalocyanine Blue, Fast Sky Blue, Pigment Green B, Malachite Green Lake and Final Yellow Green. Since in the present invention the toner is obtained by polymerization, attention must be paid to polymerization inhibitory action or aqueous phase migratory action inherent in colorants, and it is better for the colorant to be previously subjected to surface modification, e.g., hydrophilic treatment with a substance free of polymerization inhibition. In particular, most dyes and carbon black have polymerization inhibitory action and hence care must be taken when used. A preferred method for the surface treatment of dyes may include a method in which polymerizable monomers are polymerized in the presence of a dye in advance.

With regard to carbon black, not only the same treatment as the above may be applied, but alternatively a grafting treatment may preferably be applied using a substance capable of reacting with surface functional groups of the carbon black, as exemplified by polyorganosiloxane or polyethylene glycol. Few pigments other than carbon black have a strong polymerization inhibitory action. However, taking account of improvement in uniform dispersion in polymerizable monomers, the same treatment as that on carbon black may preferably be applied to the pigments.

A magnetic material may be added to toner particles to obtain a magnetic toner.

In the toner of the present invention, a charge control agent may be mixed in order to stabilize charging performance. Colorless or pale-color charge control agents that do not affect color tone of the toner are preferred.

As the polymerization initiator used in the present invention, a compound showing a half-life of 0.5 to 30 hours at the time of polymerization may be added in an amount of from 0.5 to 20% by weight based on the weight of the polymerizable vinyl monomer, whereby a polymer having a maximum molecular weight between 10,000 and 100,000 can be obtained and also favorable strength and suitable heat-melting properties can be imparted to the toner. The polymerization initiator may include azo or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutylonitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide.

In the present invention, a cross-linking agent may also be added, preferably in an amount of from 0.001 to 15% by weight.

The process for producing the toner according to the present invention may comprise uniformly dissolving or dispersing a mixture containing at least the polymerizable vinyl monomer, the styrene-diene copolymer, the colorant, the wax and the polymerization initiator (which may optionally further contain a charge control agent, a cross-linking agent, a magnetic material, an organic solvent, a release agent other than the wax, and so forth) by means of a dispersion machine such as a homogenizer, a ball mill, a colloid mill or an ultrasonic dispersion machine to prepare a polymerizable monomer composition, and then dispersing the polymerizable monomer composition in an aqueous medium containing a dispersion stabilizer to carry out granulation. In this step, in order to make the resulting toner have a sharp particle size distribution, it is better to make toner particles have the desired size at one time by the use of a high-speed stirrer or a high-speed dispersion machine such as an ultrasonic dispersion machine. Referring to the time the polymerization initiator is to be added, it may be added at the same time as other additives are added in polymerizable monomers, or may be added right before they are suspended in the aqueous medium. A polymerization initiator dissolved in the polymerizable monomer or in a solvent may be further added immediately after the granulation and before the start of polymerization.

After the granulation, the particles may be stirred by means of a conventional stirrer to such an extent that the state of particles of the polymerizable monomer composition is maintained in the aqueous medium and the particles are prevented from floating and settling.

In the process for producing the toner according to the present invention, known surface active agents or organic dispersants may be used as the dispersion stabilizer. In particular, inorganic dispersants may preferably be used since they may hardly form harmful ultrafine powder, and have attained a dispersion stability because of their steric hindrance, and hence they may hardly cause a decrease in the stability even when reaction temperature is changed, enable easy washing and may hardly adversely affect the toner. Such inorganic dispersants can be exemplified by fine phosphoric acid polyvalent metal salt powders such as calcium phosphate, magnesium phosphate, aluminum phosphate and zinc phosphate; fine carbonate powders such as calcium carbonate and magnesium carbonate; fine inorganic salt powders such as calcium metasilicate, calcium sulfate and barium sulfate; and fine inorganic hydroxide or oxide powders such as calcium hydroxide, magnesium hydroxide, aluminum hydroxide, silica, bentonite and alumina.

Any of these inorganic dispersants may preferably be used alone in an amount of from 0.2 to 20 parts by weight based on 100 parts by weight of the polymerizable vinyl monomer. As called for by the occasion, 0.001 to 0.1 part by weight of a surface active agent may be used in combination. The surface active agent may include, for example, sodium dodecylbenzenesulfonate, sodium tetradecylsulfate, sodium pentadecylsulfate, sodium octylsulfate, sodium oleate, sodium laurate, sodium stearate and potassium stearate.

When these inorganic dispersants are used, these may be used as they are. However, in order to obtain fine inorganic dispersant particles, it is preferable to form particles of the inorganic dispersent in the aqueous medium. For example, in the case of calcium sulfate, an aqueous sodium sulfate solution and an aqueous calcium chloride solution may be mixed to form fine particles of water-insoluble calcium phosphate. This enables uniform dispersion and is highly effective for achieving the stability. On this occasion, a by-product water-soluble sodium chloride is formed, but the presence of water-soluble salts in the aqueous medium inhibits the dissolution of polymerizable vinyl monomers in water to make it hard for ultrafine toner particles to be produced on emulsion polymerization. Thus, this is more advantageous. Sodium chloride is an obstacle when the remaining polymerizable vinyl monomers are removed at the stage where the polymerization is completed, and hence it is better to change the aqueous medium to new one or to carry out desalting of the aqueous medium by using an ion-exchange resin. The inorganic dispersant can be removed by dissolving it with an acid or alkali after the polymerization is completed.

In the step of polymerization, the polymerization is carried out at a polymerization temperature set at 40° C. or above, and usually at 50° to 90° C. When the polymerization is carried out within this temperature range, the wax being enclosed inside toner particles gets deposited on account of phase separation as the polymerization proceeds, so that the encapsulation can be made more perfect. In order to use up the remaining polymerizable vinyl monomers, the reaction temperature may be raised to 90° to 150° C. at the stage where the polymerization is completed.

Under such conditions, the polymerization conversion can be substantially linearly increased up to a conversion of 90%. However, the increase in the degree of polymerization becomes slow at a polymerization conversion of more than 90% where the polymerizable vinyl monomer composition becomes solid, and it becomes very slow at a polymerization conversion of more than 95%. The polymerization reaction may be allowed to proceed as it is, and may be so operated that the content of the remaining polymerizable vinyl monomer is made not more than 1,000 ppm. A method of accelerating the consumption of polymerizable monomers, known in the art in suspension polymerization, may also be used.

As a method employed in the process for producing the toner according to the present invention, there is a method in which the liquid temperature of the aqueous medium is further raised by 20° to 60° C. at the time the polymerization conversion reaches 95% or more so that the viscosity is decreased by heat and the consumption of polymerizable vinyl monomers can be accelerated by the initiation of thermal polymerization. On this occasion, the polymerizable vinyl monomers can be effectively used up when an inorganic dispersant capable of being decomposed at a high temperature is allowed to be present in the polymerizable vinyl monomer composition.

Further, it is preferable to evaporate the unreacted polymerizable vinyl monomer and/or the organic solvent under reduced pressure to make their residual content not more than 1,000 ppm. It is also possible to make the residual content of the polymerizable vinyl monomer and the organic solvent not more than 1,000 ppm by exposing toner particles wetted with water, to supersaturated water vapor while cooling the water vapor to 40° to 50° C.

Besides the foregoing, as a method of decreasing polymerizable monomers by increasing the rate of polymerization, there is a method in which the viscosity of a polymerization is decreased by putting the organic solvent in the polymerizable monomer composition or putting a plasticizer in the polymerizable monomer composition in an amount which does not make poor the anti-blocking properties of the toner produced.

As a method of removing the unreacted polymerizable vinyl monomers and the organic solvent, there are a method in which toner particles are washed with a highly volatile organic solvent which does not dissolve the binder resin of toner particles but dissolves the polymerizable vinyl monomer or organic solvent components, a method in which toner particles are washed with an acid or alkali, and a method in which a foaming agent or a solvent component which does not dissolve polymers-is put in the polymer system to make toner particles porous so that an area from which the polymerizable vinyl monomer and organic solvent components inside toner particles are volatilized may be made larger. Since it is difficult to select the solvent when taking into account such properties that toner constituents dissolve out and organic solvents remain, it is most preferable to use a method in which the polymerizable vinyl monomer and/or organic solvent components are volatilized under reduced pressure.

The content of the remaining polymerizable vinyl monomer and/or organic solvent is finally made to be at least 1,000 ppm. In order to prevent odors that may be given out during fixing, due to the polymerizable vinyl monomer and reaction residues thereof or the solvent, the content thereof may more preferably be made not more than 700 ppm, and still more preferably not more than 300 ppm.

The conversion rate of polymerization is measured using a sample prepared by adding a polymerization inhibitor to 1 g of the suspension and dissolving them in 4 ml of THF (tetrahydrofuran). The remaining polymerizable vinyl monomer and the remaining organic solvent are determined using a sample prepared by dissolving 0.2 g of toner in 4 ml of THF, and the sample is subjected to gas chromatography (G.C.) to make measurement by the internal standard method under the following conditions.

G.C. conditions
Measuring device: Shimadzu GC-15A (with a capillary)
Carrier:
$N_2$, 2 kg/cm$^2$ 50 ml/min.
Split ratio: 1:60
Linear velocity: 30 mm/sec.
Column: ULBON HR-1 50 m×0.25 mm
Temperature programming:
50° C., 5 min. hold;
elevated to 100° C. at 10° C./min.; and
elevated to 200° C. (hold) at 20° C./min.
Amount of sample: 2 μl
Indicator: Toluene

EXAMPLES

The present invention will be specifically described below by giving Examples and Comparative Examples. In the following, "part(s)" refers to "part(s) by weight".

Example 1

Into 709 parts of ion-exchanged resin, 451 parts of an aqueous 0.1M $Na_3PO_4$ solution was charged, and heated to 60° C., followed by slowly adding an aqueous 0.1M $CaCl_2$ solution to prepare an aqueous medium in which fine particles of $Ca_3(PO_4)_2$ were dispersed.

| | |
|---|---|
| Styrene | 170 parts |
| n-Butyl acrylate | 30 parts |
| C.I. Pigment Blue 15:3 | 10 parts |
| Styrene-butadiene block copolymer | 3 parts |

(CLEAREN 730L, available from Denki Kagaku Kogyo K.K.; styrene/butadiene copolymerization weight ratio: 75/25; weight average molecular weight: 100,0000; content of $CH_2$=CH— groups: about 20% by weight)

| | |
|---|---|
| Paraffin wax (melting point: 75° C.) | 20 parts |
| Di-t-butylsalicylic acid metal compound (negative charge control agent) | 5 parts |

The above materials were heated to 60° C., and then uniformly mixed, dispersed and dissolved using a TK homomixer (manufactured by Tokushu Kika Kogyo) at 12,000 r.p.m. To the resulting solution, as polymerization initiators 10 parts of 2,2'-azobis(2,4-dimethylvaleronitrile) (half-life at a temperature of 60° C.: 140 min) and 1 part of dimethyl-2,2'-azobisisobutyrate (half-life at a temperature of 60° C.: 1,270 min; half-life at a temperature of 80° C.: 80 min) were added and dissolved therein. A polymerizable monomer composition was thus prepared.

The polymerizable monomer composition obtained was charged into the above aqueous medium, followed by stirring at 10,000 rpm for 20 minutes at 60° C. using the TK homomixer in an atmosphere of nitrogen, to carry out granulation to form suspension droplets with size of toner particles. Thereafter, while stirring with paddle stirring blades, the reaction was carried out at a temperature of 60° C. for 3 hours. At this stage, the conversion rate of polymerization was 90%. Thereafter, the liquid temperature was raised to 80° C. to carry out polymerization for a further 10 hours. After the polymerization reaction was completed, the suspension was cooled, and hydrochloric acid was added to dissolve the fine particles of $Ca_3(PO_4)_2$, followed by filtration, washing with water and then drying to obtain a polymerization toner with a weight average particle diameter of 8.2 μm. This polymerization toner was deaerated for 12 hours at 45° C. under reduced pressure of 50 mmHg. At this stage, polymerizable monomers remaining in the toner were in a content of 150 ppm and the organic solvent was substantially in a content of 0 ppm.

The polymerization toner obtained had a sharp particle size distribution.

Its particle size distribution is shown in Table 1.

The particle size distribution of the toner was measured in the following way using a Coulter counter.

A Coulter counter Model TA-II (manufactured by Coulter Electronics, Inc.) was used as a measuring device. An Interface (manufactured by Nikkaki k.k.) that outputs number distribution and volume distribution and a personal computer CX-1 (manufactured by Canon Inc.) were connected. As an electrolytic solution, an aqueous 1% NaCl solution was prepared using first-grade sodium chloride. Measurement was carried out by adding as a dispersant from 0.1 to 5 ml of alkylbenzene sulfonate, to from 100 to 150 ml of the above aqueous electrolytic solution, and further adding from 2 to 20 mg of a sample to be measured. The electrolytic solution in which the sample has been suspended was subjected to dispersion treatment for about 1 minute to about 3 minutes with an ultrasonic dispersion machine. Particle size distribution of particles of 2 to 40 μm diameter was measured on the basis of number, by means of the above Coulter counter Model TA-II using an aperture of 100 μm as its aperture.

With respect to 100 parts of the toner thus obtained, 0.8 part of hydrophobic fine silica powder was externally added. Next, 30 parts of the silica-externally-added toner and 570 parts of a resin-coated magnetic ferrite carrier were blended to produce a two-component type developer.

Using this two-component type developer, images were reproduced using a modified machine of a commercially available full-color copying machine (CLC- 500, manufactured by Canon Inc.). Development was carried out under conditions of a development contrast of 320 V in an environment of 23° C./65% RH.

Unfixed images formed only by development and transfer carried out on transfer mediums using the modified machine, were fixed using a fixing-temperature variable external fixing assembly (a fluorine resin type soft roller was used as a fixing roller, and a silicone rubber type roller as a pressure roller; having no mechanism for application of silicone oil.)

The fixed images obtained were formed without offset and a superior fixing performance was seen. This two-component type developer was left standing in an environment of temperature 35° C. for 1 month, and then images were again reproduced similarly. As a result, toner images having image quality not different from those before standing were formed.

Next, about 3 g of the toner was put in a 100 ml container of about 5 cm diameter, and was left standing for a day in an environment of temperature 45° C. and relative humidity about 60±5%. Thereafter, the toner was passed through a 20 mesh (U.S. type) sieve. As a result, the toner remaining thereon had no agglomerates larger than about 1 mm in major diameter, and it was confirmed that the toner had superior anti-blocking properties.

Comparative Example 1

In Example 1, the same state was kept also after the 3 hour reaction. After 8 hours in total, at the time the polymerization conversion reached 99% or more, the toner particles were taken out and the dispersant was washed away, followed by drying. At this stage, the remaining polymerizable monomers were in a content of 4,000 ppm. Using the toner obtained, a two-component type developer was prepared in the same manner as in Example 1, and images were reproduced in the same way. As a result, good images not different from those in Example 1 were formed. However, the surrounding of the fixing assembly smelled of styrene. This two-component type developer was left in an environment of 35° C. for 1 month. As a result, the quantity of triboelectricity of the toner greatly decreased, so that toner images with very much fog were formed.

Its anti-blocking properties were also tested in the same manner as in Example 1. As a result, toner agglomerates larger than about 1 mm in major diameter were seen.

Example 2

A toner was prepared in the same manner as in Example 1 except that the styrene-butadiene block copolymer was replaced with 4 parts of a styrene-butadiene block copolymer KRO3 (available from Nippon Steel Chemical Co., Ltd.; styrene/butadiene copolymerization weight ratio: 75/25; weight average molecular weight: 200,0000). The toner was further similarly treated under reduced pressure. The polymerizable monomers remaining in the resulting toner were in a content of 300 ppm and the organic solvent was in a content of substantially 0 ppm.

Example 3

A toner was prepared in the same manner as in Example 1 except that 3 parts of a styrene-methyl methacrylate-methacrylic acid copolymer (copolymerization weight ratio: 96:3:1; weight average molecular weight: 50,0000; acid value: 20) was further added. The toner was further similarly treated under reduced pressure. The polymerizable monomers remaining in the resulting toner were in a content of 650 ppm and the organic solvent was in a content of substantially 0 ppm.

Example 4

A toner was prepared in the same manner as in Example 1 except that the styrene-butadiene block copolymer was replaced with 4 parts of a styrene-butadiene block copolymer ASAFLEX 805 (available from Asahi Chemical Industry Co., Ltd.; styrene/butadiene copolymerization weight ratio: 80/20; weight average molecular weight: 110,0000). The toner was further similarly treated under reduced pressure. The polymerizable monomers remaining in the resulting toner were in a content of 300 ppm and the organic solvent was in a content of substantially 0 ppm.

Comparative Example 2

A toner was prepared in the same manner as in Example 1 except that no styrene-butadiene block copolymer was contained in the polymerizable monomer composition. The toner was further similarly treated under reduced pressure. The resulting toner had a broader particle size distribution than Example 1, and the polymerizable monomers remaining in the resulting toner were in a content of 4,500 ppm.

A two-component type developer was prepared in the same manner as in Example 1, and images were reproduced to make the test in the same way. As a result, its developing performance and anti-offset properties were clearly inferior to those in Example 1.

Its anti-blocking properties were also tested in the same manner as in Example 1. As a result, toner agglomerates larger than about 1 mm in major diameter were seen.

Comparative Example 3

A toner was prepared in the same manner as in Example 1 except that the styrene-butadiene block copolymer was replaced with 3 parts of a styrene-butadiene block copolymer CALIFLEX TRKX138S (available from Shell Kagaku K.K..; styrene/butadiene copolymerization weight ratio: 40/60; weight average molecular weight: 80,0000). The polymerizable monomers remaining in the resulting toner were in a content of 4,200 ppm.

A two-component type developer was prepared in the same manner as in Example 1, and images were reproduced to make the test in the same way. As a result, its developing performance and anti-offset properties were clearly inferior to those in Example 1.

Its anti-blocking properties were also tested in the same manner as in Example 1. As a result, toner agglomerates larger than about 1 mm in major diameter were seen.

The average particle diameter and particle size distribution of the toners obtained in Examples 1 to 3 and Comparative Example 2 and 3 are shown in Table 1 below.

TABLE 1

| | Weight average particle diameter (μm) | Content of toner particles with particle diameters of ≦4.00 μm (% by number) | ≧16.0 μm (% by volume) |
|---|---|---|---|
| Example: | | | |
| 1 | 8.2 | 14.0 | 1.0 |
| 2 | 8.1 | 14.5 | 0.9 |
| 3 | 8.2 | 14.2 | 0.7 |
| Comparative Example: | | | |
| 2 | 8.5 | 18.7 | 2.1 |
| 3 | 8.7 | 17.1 | 2.3 |

The toners obtained in Comparative Examples 2 and 3 had broader particle size distribution than the toners obtained in Examples 1 to 3.

Comparative Example 4

The toner obtained in Comparative Example 3 was treated under reduced pressure in the same manner as in Example 1. Thus, a toner having polymerizable monomers in a content of 200 ppm was prepared.

Example 5

A toner was prepared in the same manner as in Example 1 except that 3 parts of a styrene-butadiene random copolymer having a styrene/butadiene copolymerization weight ratio of 75/25 was used. The toner was further similarly treated under reduced pressure. The polymerizable monomers remaining in the resulting toner were in a content of 250 ppm and the organic solvent was in a content of substantially 0 ppm.

Test results and other data in Examples 1 to 5 and Comparative Examples 1 to 4 are shown in Table 2 below.

What is claimed is:

1. A toner for developing an electrostatic image, comprising toner particles containing a binder resin, a colorant and a wax, wherein:

said toner contains polymerizable vinyl monomer or a mixture of organic solvent and polymerizable vinyl monomer in an amount of not more than 1,000 ppm; and said toner particles are obtained by forming a polymerizable monomer composition comprising (a) one or plural kinds of polymerizable vinyl monomer, (b) a styrene-diene copolymer comprised of styrene or a styrene derivative and butadiene or isoprene in a copolymerizable weight ratio from 95:5 to 65:35, (c) the colorant, (d) the wax and (e) a polymerization initiator; dispersing the polymerizable monomer composition in an aqueous medium to carry out granulation; and polymerizing the polymerizable vinyl monomer in the aqueous medium.

2. The toner according to claim 1, wherein said polymerizable vinyl monomer comprises a styrene, an acrylate, a methacrylate or a mixture of any of these.

3. The toner according to claim 2, wherein said styrene-diene copolymer is a styrene-butadiene copolymer, and the styrene-butadiene copolymer is a block copolymer of a polystyrene structural unit and a polybutadiene structural unit.

4. The toner according to claim 1, wherein said styrene-diene copolymer is a styrene-butadiene copolymer, and the styrene-butadiene copolymer has from 5% by weight to 60% by weight of $CH_2{=}CH{-}$ groups.

5. The toner according to claim 1, wherein said wax is contained in the toner in an amount of from 5% by weight to 30% by weight.

6. The toner according to claim 1, wherein said wax is contained in the toner in an amount of from 5% by weight to 30% by weight, and said styrene-diene copolymer is contained in an amount of from 1% by weight to 50% by weight based on the weight of the wax.

7. The toner according to claim 1, wherein said styrene-diene copolymer is locally present on the surfaces of said toner particles.

TABLE 2

| | Styrene-butadiene copolymer Amount (parts) | Styrene/butadiene copolymerization ratio | Copolymerization form | Remaining polymerizable monomer content (ppm) | Remaining organic solvent content (ppm) | Image density Initial stage | After 10,000sh. running | Fixing temp. range (°C.) | Anti-blocking properties |
|---|---|---|---|---|---|---|---|---|---|
| Example: | | | | | | | | | |
| 1 | 3 | 75/25 | Block | 150 | 0 | 1.80 | 1.81 | 135–200 | A |
| 2 | 4 | 75/25 | Block | 300 | 0 | 1.80 | 1.81 | 135–200 | A |
| 3 | 3 | 75/25 | Block | 650 | 0 | 1.75 | 1.65 | 135–200 | B |
| 4 | 4 | 80/20 | Block | 300 | 0 | 1.80 | 1.81 | 135–200 | A |
| 5 | 3 | 75/25 | Random | 250 | 0 | 1.70 | 1.65 | 125–180 | B |
| Comparative Example: | | | | | | | | | |
| 1 | 3 | 75/25 | Block | 4,000 | 0 | 1.65 | 1.40 | 135–200 | C |
| 2 | 0 | — | — | 4,500 | 0 | 1.65 | — | 125–170 | C |
| 3 | 3 | 40/60 | Block | 4,200 | 0 | 1.65 | 1.35 | 130–180 | C |
| 4 | 3 | 40/60 | Block | 200 | 0 | 1.65 | 1.45 | 130–180 | A |

Remarks:
1) Toner of Comparative Example 2 made it impossible to continue the running test.
2) At temperatures outside the fixing temperature range, low-temperature offset or high-temperature offset occurred.
3) Evaluation of anti-blocking properties: A: Good; B: Passable; C: Poor 8. The toner according to claim 1, wherein said wax has a melting point of from 50° C. to 90° C.

9. The toner according to claim 1, wherein said styrene-diene copolymer has a weight average molecular weight of from 30,000 to 500,000.

10. The toner according to claim 1, wherein said toner contains toner particles with particle diameters of larger than 16.0 μm in an amount of less than 2% by volume.

11. A process for producing a toner, comprising the steps of:

mixing a mixture containing, at least, one or plural kinds of polymerizable vinyl monomer, a styrene-diene copolymer comprised of styrene or a styrene derivative and butadiene or isoprene in a copolymerization weight ratio of from 95:5 to 65:35, a colorant, a wax and a polymerization initiator to prepare a polymerizable monomer composition;

dispersing the polymerizable monomer composition in an aqueous medium to carry out granulation; and polymerizing the polymerizable vinyl monomer in the aqueous medium to produce toner particles which contain a binder resin, the colorant and the wax, and contain polymerizable vinyl monomer or a mixture of organic solvent and polymerizable vinyl monomer in an amount of not more than 1,000 ppm.

12. The process according to claim 11, wherein said toner particles are treated under reduced pressure.

13. The process according to claim 11, wherein said styrene-diene copolymer is a styrene-butadiene copolymer, and is contained in the polymerizable monomer composition in an amount of from 0.1% by weight to 20% by weight.

14. The process according to claim 11, wherein said polymerizable monomer composition is polymerized by suspension polymerization.

15. The process according to claim 11, wherein said polymerizable vinyl monomer contains the wax in an amount of from 5% by weight to 30% by weight.

16. The process according to claim 11, wherein said polymerizable vinyl monomer contains at least two kinds of polymerization initiator having different half-lives.

17. The process according to claim 11, wherein said toner particles are treated under reduced pressure so as for the polymerizable vinyl monomer to come to be in a content of not more than 700 ppm.

18. The process according to claim 11, wherein said toner particles are treated under reduced pressure so as for the polymerizable vinyl monomer to come to be in a content of not more than 300 ppm.

* * * * *

UNITED STATES PATENT AND TRADEMARK OFFICE

CERTIFICATE OF CORRECTION

PATENT NO. : 5,571,653

DATED : November 5, 1996

INVENTOR(S) : TASASHIGE KASUYA ET AL.

It is certified that error appears in the above-identified patent and that said Letters Patent is hereby corrected as shown below:

ON THE TITLE PAGE:

AT [75] INVENTORS

"Makoto Kanabayashi" should read --Makoto Kanbayashi--.

COLUMN 2

Line 51, "wherein;" should read --wherein:--.

COLUMN 4

Line 50, "improves" should read --improve--.

COLUMN 5

Line 10, "contained" should read --be contained--.

COLUMN 6

Line 24, "Hanza" should read --Hansa--.
Line 27, "Prussion" should read --Prussian--.
Line 29, "Rhodamin" should read -Rhodamine--.
Line 46, "the" should be deleted.

COLUMN 8

Line 21, "new" should read --a new--.

COLUMN 10

Line 7, "3 parts" should read
--3 parts (15% by weight based on wax)--.
Line 12, "100,0000;" should read --100,000;--.

UNITED STATES PATENT AND TRADEMARK OFFICE

CERTIFICATE OF CORRECTION

PATENT NO. : 5,571,653

DATED : November 5, 1996

INVENTOR(S) : TASASHIGE KASUYA ET AL.

It is certified that error appears in the above-identified patent and that said Letters Patent is hereby corrected as shown below:

COLUMN 12

Line 1, "200,0000)." should read --200,000).--.
Line 25, "110,0000)." should read --110,000).--.
Line 56, "80,0000)." should read --80,000).--.

COLUMN 13

Line 3, "Example 2" should read --Examples 2--.

Signed and Sealed this

Fifteenth Day of April, 1997

*Attest:*

*Attesting Officer*

BRUCE LEHMAN

*Commissioner of Patents and Trademarks*